United States Patent [19]

Taylor

[11] 4,021,630

[45] May 3, 1977

[54] HERMETICALLY SEALED RESILIENT CONTACT SWITCH HAVING SURGICAL APPLICATIONS

[75] Inventor: Charles E. Taylor, Evergreen, Colo.

[73] Assignee: Neomed Incorporated, Boulder, Colo.

[22] Filed: Apr. 25, 1975

[21] Appl. No.: 571,516

[52] U.S. Cl. ..... 200/159 B; 200/302

[51] Int. Cl.[2] ..... H01H 13/52; H01H 9/04

[58] Field of Search ..... 200/5 R, 5 A, 159 B, 200/293, 294, 295, 296, 302, 340, 243; 128/303.14, 303.17

[56] References Cited

UNITED STATES PATENTS

| | | | |
|---|---|---|---|
| 2,343,060 | 2/1944 | Horning | 200/159 B X |
| 2,409,483 | 10/1946 | Gandelot | 200/159 B X |
| 2,562,185 | 7/1951 | Gross | 200/159 B |
| 3,054,879 | 9/1962 | Soreng | 200/159 B |
| 3,684,842 | 8/1972 | Boulanger | 200/159 B X |
| 3,699,294 | 10/1972 | Sudduth | 200/159 B X |
| 3,749,859 | 7/1973 | Webb et al. | 200/159 B X |
| 3,846,596 | 11/1974 | Wolf | 200/294 |
| 3,860,771 | 1/1975 | Lynn et al. | 200/159 B X |
| 3,898,421 | 8/1975 | Suzumura | 200/159 B |
| 3,911,241 | 10/1975 | Jarrard | 200/302 X |
| 3,932,722 | 1/1976 | Obata et al. | 200/340 |
| 3,967,085 | 9/1976 | Lockard et al. | 200/302 |
| 3,967,089 | 9/1976 | Hyltin | 200/159 B |

FOREIGN PATENTS OR APPLICATIONS

| | | | |
|---|---|---|---|
| 606,437 | 7/1960 | Italy | 200/159 R |

*Primary Examiner*—James R. Scott
*Attorney, Agent, or Firm*—John E. Reilly

[57] ABSTRACT

A switching circuit is completed between electrical contacts by a flexible cap overlying the contact points. The cap is formed with cylindrical sidewalls and an upper end closure which has a plunger or piston-like portion extending therefrom towards the contact points. The dome section is arranged so as to arc from the cylindrical sidewalls in a direction away from the contact points so that depression of the dome will not effect collapsing of the cylindrical sidewalls for the entire extent of the contact establishing travel. The cap can deflect a metal dome to perform the contact establishment or can be composed of a resilient conductive material to directly establish electrical contact.

10 Claims, 3 Drawing Figures

HERMETICALLY SEALED RESILIENT CONTACT SWITCH HAVING SURGICAL APPLICATIONS

CROSS REFERENCE TO RELATED APPLICATION

The resilient contact switches of this application are particularly well suited for use in the structure shown in the application entitled IMPROVED ELECTRO-SURGICAL INSTRUMENT by J. M. Esty and C. E. Taylor, Ser. No. 571,508 filed concurrently herewith and assigned to the same assignee as this application.

BACKGROUND OF THE INVENTION

The present invention relates to apparatus for establishing an electrical circuit between a plurality of contact points. More particularly, the present invention relates to devices for completing the electrical circuit between a plurality of contact points on a momentary basis. Still further, this invention is concerned with apparatus for completing an electrical circuit between a plurality of contact points for only so long as the switch is continuously actuated, the electrical contact being automatically opened when actuation is removed. Although various applications of the present invention will be readily apparent, the invention is especially useful in conjunction with surgical apparatus which requires sealing of the contact switch externally so that it can perform reliable long-term operations without being internally contaminated from seepage while tolerating relatively high temperature and/or chemical fluid environment exposures such as are associated with sterilization of surgical instruments.

A relatively large variety of momentary switch devices have developed in the past. For instance, U.S. Pat. No. 2,343,060 by Horning shows a resilient casing for a switching apparatus wherein raised buttons on the casing indicate the switch positions. By pressing on a selected one of these raised portions, an underlying rocker switch arrangement can be actuated through deflection of the external casing. Similarly, U.S. Pat. No. 3,732,384 by Fischel shows an elongated flexible plunger arrangement for deforming metal contacts into electrical connection.

More recently, there has been extensive activity towards the development of inexpensive switches for use in various keyboard operations such as the input keyboard for a calculator. Many such devices use a generally rigid key cap which is held in a guiding frame and overlies a spring-like metal dome. By pushing the cap downward through its guideway and against the upper perimeter of the metal dome, the dome is deformed temporarily downward against the contact points to establish the circuit therebetween. It has also been suggested that these keyboard caps can be molded as a single unit for application over a dome cage. For instance, U.S. Pat. No. 3,684,842 by Boulanger shows examples of both aforementioned key input arrangements. An arrangement for providing externally sealed switches of possible use in electro-surgical applications is shown in copending application Ser. No. 315,678, filed Dec. 15, 1972 entitled SWITCHING DEVICE FOR ELECTRO-SURGICAL INSTRUMENTS by J. W. Jarrard, now U.S. Pat. No. 3,911,241, which is assigned to the same assignee of the present application.

There has been a continuing need for a keyboard switch actuating cap arrangement which is adaptable for any keyboard configuration somewhat like the relatively rigid plastic cap apparatus but which is suitable for total sealing of the keyboard cap from the environment. Further, there is a need for such a keyboard actuator switch cap which does not require special molds for all potential key positions but which can employ a relatively standard cap arrangement. This need is particularly acute in conjunction with surgical apparatus which is exposed to various potential contaminants and which must be capable of enduring sterilization processing particularly using elevated temperatures in a chemical fluid environment. The use of momentary contacts for hand-held devices as electro-surgical switch controls hazards several problems which have not been satisfactorily resolved by the prior art devices. For instance, entry of blood which is a good electrical conductor into the switch housing not only can erroneously short the switch contacts but also can provide a path for the radio frequency or RF signals into the hand of the surgeon. In addition, the switch arrangement must be such as to prevent migration of contaminants or foreign matter from the switch into the sterile field or wound area.

SUMMARY OF THE INVENTION

This invention is a momentary electrical circuit establishing switch configuration which is well suited for providing total sealing relative to the external environment. A resilient cap composed of a cylindrical sidewall has one end enclosed by an arcuate dome which is arched away from the contact points to be actuated. A plunger arrangement extends towards the contact points from the general center of the dome. This results in a relatively thin dome wall between the cylindrical sidewalls and the plunger such that there will be no collapsing of the sidewalls when the switch is actuated so as to move the central plunger portion into electrical contact establishing positions. Release of the switch results in return of the dome to its original orientation because of its arcuate configuration. The electrical circuit between contact points underlying the cap can be established either via a deflectable metal dome or by fabricating at least the central plunger portion of the cap from a resilient conductive material or with a conductive coating thereon. The sidewalls of the resilient cap can be made larger than its retaining frame on the housing so that its compression during assembly will further augment environmental sealing.

An object of the invention is to provide apparatus useful for electrical circuit completion between a plurality of contact points.

Another object of this invention is to provide momentary electrical switching operations.

Yet another object of this invention is to provide momentary electrical contacts through an apparatus which can be reliably sealed from the environment.

A further object of this invention is to provide a momentary electrical switch which is externally accessible for actuation but sealable within its operating environment so that the seal will not be disturbed through actuation.

A still further object of this invention is to provide momentary electrical switching means which is sealed so as to be compatible with the environment of electro-surgical procedures and/or chemical sterilization.

The foregoing and other objects, features and advantages of the present invention will be more apparent in the light of the following description of exemplary preferred embodiments.

DETAILED DESCRIPTION OF THE PREFERRED EMBODIMENT

Figure 1:
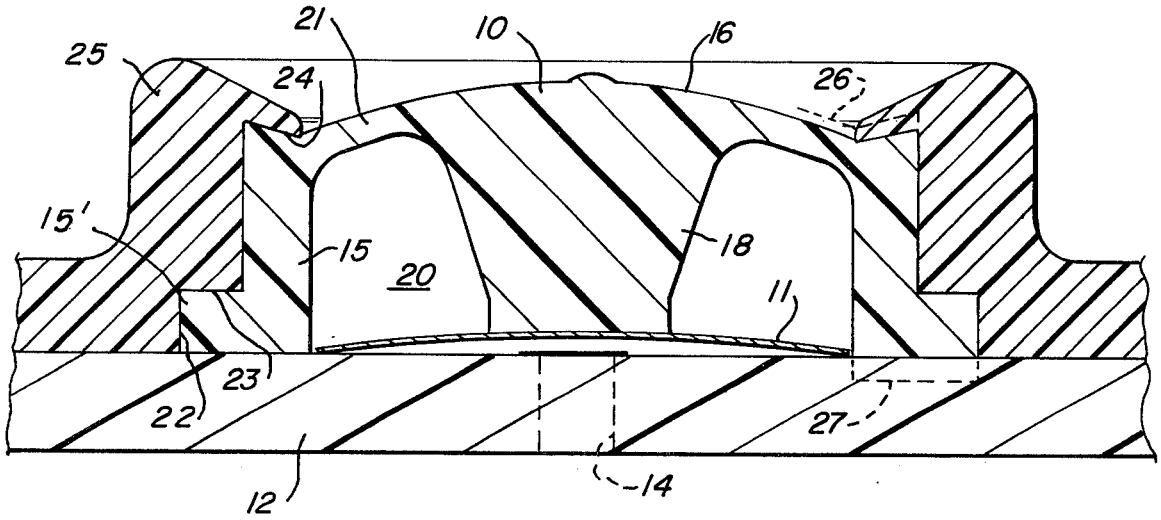
FIG. 1 is a side partially sectioned view of one embodiment of the present invention shown in conjunction with a deflectable metal dome and circuit board.
Figure 2:
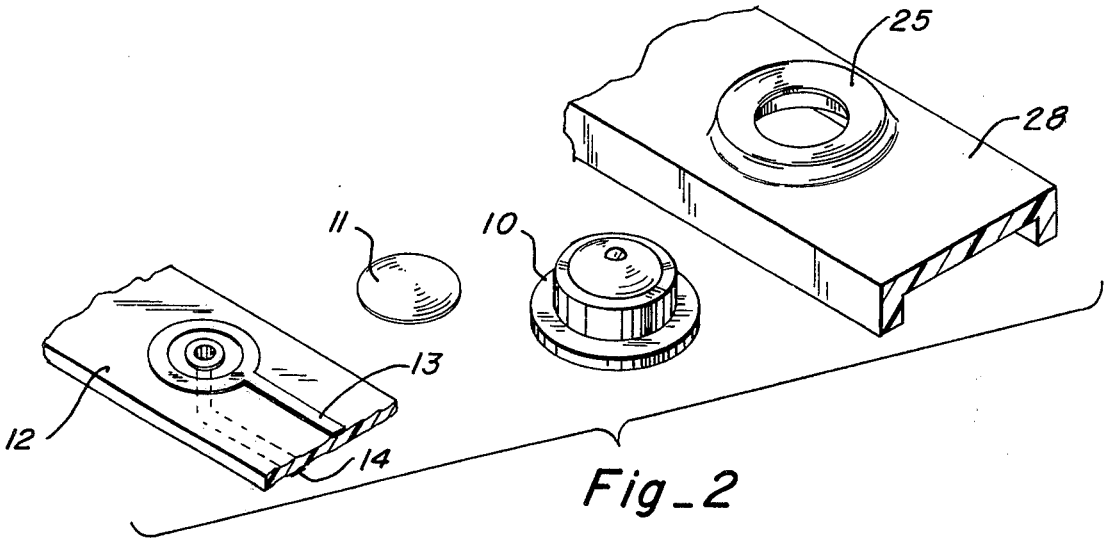
FIG. 2 is a exploded perspective view of a typical assembly in accordance with the FIG. 1 embodiment.

An example of an arrangement for implementing the present invention in conjunction with deflectable metal domes is shown in FIGS. 1 and 2. As seen in the section view of FIG. 1, cap 10 is fabricated of a flexible material such as silicone rubber and positioned over an arcuate or convex deflectable metal dome or plate 11 so as to establish contact between circuit points on the circuit board 12. As shown in FIG. 2, the printed circuit board conductors 13 and 14 are arranged so that the circular portion of conductor 13 underlies the peripheral edge of the convex deflectable dome 11. Conductor 14 is insulated from the peripheral edge of dome 11 but arranged to be spaced beneath and to underlie the raised center portion of dome 11. Preferably, conductor 13 is arranged as a circular ring as shown to reduce the tolerances necessary in locating dome 11 during fabrication. Accordingly, the electrical contact point for conductor 14 is preferably established through circuit board 12 by any of several well-known means. Accordingly axial downward depression of dome 11 will establish contact at the center thereof with conductor 14 thereby establishing an electrical circuit between conductors 13 and 14. Various other arrangements for locating a plurality of electrical contact points under the dome 11 can be used such as through one or more contacts extending along one side of circuit board 12 instead of being located on opposite surfaces thereof with an axially oriented contact as shown.

Flexible cap 10 preferably is of inverted generally cup-shaped configuration and includes a generally cylindrical, upstanding sidewall 15 and an arcuate dome portion 16 which has a generally piston-shaped downwardly convergent plunger element 18 extending downwardly along the central axis of the dome. Thus, a generally circular or annular channel 20 is formed below a relatively thin membrane-like annular cross-sectional area 21 of the upper portion 16 of the cap 10 in surrounding relation to the plunger 18. This configuration permits axial movement of the dome 16 and plunger 18 downwardly so as to deflect dome 11 into electrical contact with the points thereunder and this action results in deformation of the membrane-like portion 21 without imparting inward collapsing forces to the cylindrical sidewall 15. Therefore, cylindrical sidewall 15 can be bonded securely within a retainer base or sleeve 25 protruding outwardly from a cover retaining plate 28 at the edges thereof and this bond will not be disturbed by actuations of dome 10.

Furthermore, it has been found that a seal without bonding which is satisfactory for many applications can be obtained. This bondless seal is effected by fabricating resilient cap 10 to be larger than the bore in retaining sleeve 25 into which cap 10 is inserted. The oversize dimensions of cap 10 are indicated generally in FIG. 1 by dashed lines 26 and 27. Accordingly, placement of cap 10 in the associated bore of retaining sleeve 25 and circuit board 12 in abutting relation as shown in FIG. 1 results in compression of sidewall 15. This compression effects a pressure seal at circumferential interfaces 22, 23 and 24 formed along the inner wall surface of the sleeve 25 and cooperates with the arcuate dome portion 21 to insure that the switch assembly is positively sealed from the external environment. Of course, interfaces 22, 23 and/or 24 can also be bonded if desired, the interface 24 defining a retaining collar around the upper edge of the sidewall 15, and the interfaces 22 and 23 defining a groove for reception of a flange portion 15′ at the lower edge of the sidewall 15.

The advantages of this configuration are particularly significant when a switch as shown is employed for use in conjunction with a surgical instrument. Thus, if actuation of the deformable cap 10 resulted in inward or collapsing stresses between sidewall 15 and the inner surface of the bore through sleeve 25, the integrity of the sealing therebetween will be compromised particularly at interface 24 thus hazarding entrapment of foreign matter or undesirable seepage of fluids into the switch interior. When used as an element of a surgical instrument, such materials can include any of a variety of substances and thus degrade the reliability of sterilization of the device as well as the useful life of the device. Still further, operation of the switch during surgical procedure can result in release of potentially contaminating particles into the sterile field. Perhaps even more importantly, seepage of blood or other conductive fluids into the switch interior can cause unintended shorting of contacts 13 and 14 as well as provide an RF path to the hands of the operator.

The arcuate dome 16 of cap 10 further insures that it will return to its undeflected position as shown in FIG. 1 after removal of the downward axial actuating pressure. The metallic dome 11 likewise has positional memory and will return to its undeflected position shown in FIG. 1 when the actuation pressure is removed thereby assisting the dome 16 in returning to its undeflected position. The positioning of dome 11 over circuit board 12 can be effected during assembly by a variety of procedures. For instance, it could be placed over the contacts and then retained by bonding a thin plastic sheet over the entire assembly. Further, the actuating cap arrangement can likewise accomodate positioning of dome 11 within a dome cage as is well known in the art. In some applications, the lower peripheral surface 22 of cap 10 can be placed over the dome in position and surface 22 as well as retaining base or sleeve 25 bonded onto or around circuit board 12. By constructing retaining base 25 of a polycarbonate, merlon M-50, Lexan 2014, Polysulfono "UDEL" (Unioncarbide), or equivalent and cap 10 from silicon rubber or the like, the assembly can be easily completed by sonic welding at the interfaces.

Figure 3:
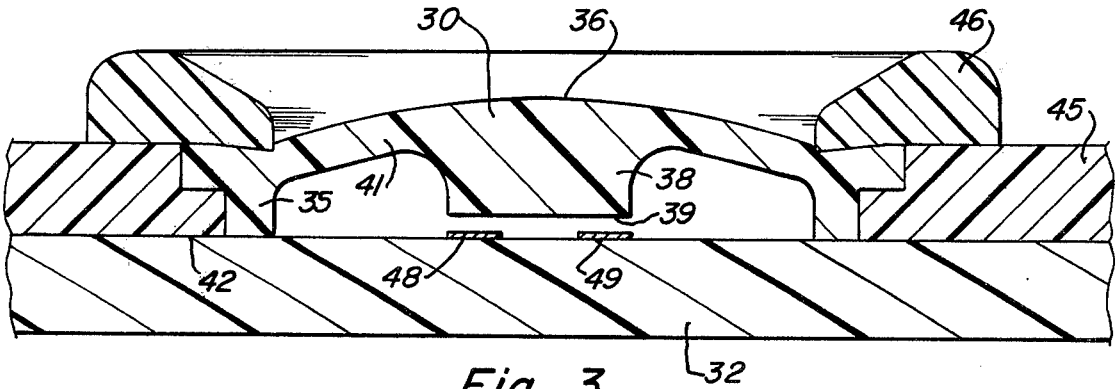
FIG. 3 is a partially sectioned side view of another exemplary embodiment of this invention.

FIG. 3 shows another embodiment of the present invention which is particularly well-suited for low profile switches. In this version, cap 30 which can be formed in the same shape as cap 10 of FIG. 1 but which is preferably formed of a lower cross-sectional profile as shown in FIG. 3, is preferably constructed of a resilient conductive material such as commercially available conductive silicone rubber. In this case no metallic dome is included and cap 30 is positioned directly over the electrical contact points on circuit board 32. For example, cylindrical sidewall 35 is positioned directly over at least one of the circuit contact points and downwardly extending piston portion 38 overlies at least one other circuit contact point. By including an upper dome-shaped surface 36 over plunger cylinder 38 with relatively narrow side sections 41, dome 30 can be deflected downward so as to establish contact between the upper surface contact point on board 32 and thus establish conductivity between that point and the contacts on board 32 in electrical communication with sidewall 35. Further, this is effected without producing any inwardly collapsing effect on sidewall 35.

As shown in FIG. 3, cap 30 is initially placed within base 45 and retaining collar 46 placed thereover. As with cap 10, the cylindrical sidewall 35 can be oversized relative to the height of the bore through base 45 for enhancing the final seal. By appropriate selection of materials for base 45 and collar 46 such as those mentioned previously for base 25, the entire assembly as generally shown in FIG. 3 can be sonically welded together as a unit. Further, there will be no tearing at the seams between cap 30 and collar 46 so as to provide potential invasion therein of contaminants. Note further that low profile cap 30 can be constructed of a flexible non-conductive material if desired with a conductive material being used for plunger 38 or a conductive plate being bonded to the lower surface 39 of plunger 38. Under this arrangement, the contact points for board 32 which are to be involved in the switching operation are then all located beneath surface 39. This also permits location of the hands or conductors on a common surface of board 32 since they would not be shorted by the peripheral interface surface 42 of cap 30.

Although the present invention has been described with particularity in conjunction with the detailed description of the exemplary preferred embodiments, various changes, additions, applications and modifications can be made therein without departing from the spirit of this invention.

What is claimed is:

1. A resilient contact switch adapted for providing momentary electrical switching in electro-surgical instruments and the like comprising:

an insulator board having at least two electrical contact points arranged in a common plane on one surface thereof, a cover plate overlaying said insulator board having therethrough a bore with first and second open ends, said cover plate being positioned adjacent to said board so that said two contact points are at said first end of said bore, a cap of inverted generally cup-shaped configuration including a cylindrical sidewall within said cover plate bore, a flexible end closure and a plunger portion with said end closure one end of said sidewall and having said plunger portion extending in inner spaced concentric relation to said cylindrical sidewall from said end closure, said end closure between said sidewall and said plunger portion having a relatively narrow membrane-like cross-section which arches outwardly relative to the interior defined by said sidewall and further being positioned in the plane of said second end of said bore, sealing means between said cover plate and said sidewall to sealingly position said sidewall on said insulator board in surrounding relation to said contact points and means actuated by axial movement of said plunger portion for establishing electrical communication between said electrical contact points, whereby application of an inwardly directed axial force to said end closure relative to said cylindrical sidewall causes said piston portion to actuate said electrical communication establishing means without imparting inward collapsing forces to said sidewall and said end closure will return to its outward arching posture upon removal of the axial force thereby deactivating the electrical contact establishing means.

2. Apparatus in accordance with claim 1 wherein said electrical contact establishing means includes a deflectable metallic dome mounted in said first open end of said bore with the central portion of said dome extending into said bore, the peripheral edge of said dome being electrically connected to at least one of said contact points and at least one other of said contact points being positioned under said central portion, said central portion being further positioned in proximity to the end of said piston portion of said cap opposite said end closure, whereby application of an inward axial force to said piston portion via said end closure deflects said dome into establishing electrical communication between said contact points whereas said dome and said end closure return to their arched configuration upon removal of the axial force.

3. Apparatus in accordance with claim 1 wherein said electrical communication establishing means is a conductive surface on the end of said plunger portion opposite said end closure, said contact points being arranged on said insulator board so that at least two of said points are in electrical communication through said conductive surface when said plunger portion has been moved axially within said sidewall in response to application of an inward axial force to said end closure.

4. Apparatus in accordance with claim 1 wherein said cap is composed of a resilient electrically conductive material, said electrical communication establishing means including means for electrically connecting at least one said contact point to said sidewall and at least one other said contact point is located in the axial line of travel of the end of said plunger portion for establishing electrical contact therewith in response to application of an inward axial force to said end closure.

5. Apparatus in accordance with claim 1 wherein said cover plate bore has an inwardly extending radial shoulder at said second end, said cylindrical sidewall of said cap being formed of a resilient material with the cylindrical length thereof being greater than the depth of said bore, and means for compressively retaining said cylindrical sidewall within said bore between said radial shoulder and said first end thereof.

6. Apparatus for establishing an electrical circuit between at least two spaced contact points disposed in a common plane on an insulator plate wherein an electrically conductive element is normally disposed in spaced relation to said contact points and is deflectable into bridging electrical contact with said contact points comprising:

a cap of inverted, generally cup-shaped configuration including an outer sidewall having the plane of a first end thereof arranged parallel to but spaced from the plane of the contact points, an arcuate dome of flexible material extending across the first end of said sidewall and having a cross-section with a curvature oriented arcuately away from the plane of the contact points, and a plunger extending from said dome in inner spaced concentric relation to said sidewall into contact with said conductive element and in adjacent but spaced relation to the plane of the contact points, said dome being of sufficient flexibility so that when said dome is deflected toward the plane of said contact points said plunger is movable to deflect said electrically conductive element into bridging electrical contact with said spaced contact points without imparting inward collapsing forces to said sidewall, and retaining means in outer surrounding relation to said sidewall whereby to sealingly retain said sidewall against said insulator plate in surrounding relation to said spaced contact points.

7. Apparatus in accordance with claim 6 in which said retaining means is defined by an outer concentric retainer sleeve extending away from said insulator plate into surrounding relation to said sidewall.

8. Apparatus in accordance with claim 7, said retainer sleeve including a retainer collar overlaying the first end of said sidewall.

9. Apparatus in accordance with claim 8, said retaining means including a substantially flat cover plate in sealed relation to said insulating plate and said retaining sleeve extending away from said cover plate to define a bore therethrough with the spaced contact points arranged in a plane at one end of said bore, said sidewall being enclosed within said retainer sleeve so that said dome is disposed at the end of said bore opposite to the one end and deflection of said dome will not impart separating forces to the interface between said sidewall and said retaining sleeve.

10. Apparatus in accordance with claim 6 wherein said retaining means includes a cover plate over said insulating plate and a retaining sleeve having an inwardly extending radial collar, said sidewall composed of a compressible material having a longitudinal dimension greater than the depth of said retainer sleeve and means for compressibly retaining said sidewall within said sleeve between said retaining collar and said insulating plate.

* * * * *

UNITED STATES PATENT OFFICE

CERTIFICATE OF CORRECTION

Patent No. 4,021,630 Dated May 3, 1977

Inventor(s) Charles E. Taylor

It is certified that error appears in the above-identified patent and that said Letters Patent are hereby corrected as shown below:

Column 3, line 50, cancel "the" second occurrence.

Claim 1, Column 5, line 55, after "closure" add -- enclosing --

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*